US009829275B2

(12) United States Patent
Madrid et al.

(10) Patent No.: US 9,829,275 B2
(45) Date of Patent: Nov. 28, 2017

(54) FIREARM MONITORING AND TRACKING SYSTEM

(71) Applicant: Safety Trace, LLC, Weslaco, TX (US)

(72) Inventors: Jack Fredrick Madrid, Rancho Cucamonga, CA (US); Michael Nyberg, Spring Hill, TN (US)

(73) Assignee: Safety Trace, LLC, Weslaco, TX (US)

( * ) Notice: Subject to any disclaimer, the term of this patent is extended or adjusted under 35 U.S.C. 154(b) by 0 days.

(21) Appl. No.: 15/057,910

(22) Filed: Mar. 1, 2016

(65) Prior Publication Data

US 2017/0003101 A1 Jan. 5, 2017

Related U.S. Application Data

(60) Provisional application No. 62/187,916, filed on Jul. 2, 2015.

(51) Int. Cl.
*F41C 33/02* (2006.01)
*G08B 25/01* (2006.01)

(52) U.S. Cl.
CPC ..... *F41C 33/029* (2013.01); *F41C 33/0209* (2013.01); *G08B 25/016* (2013.01)

(58) Field of Classification Search
None
See application file for complete search history.

(56) References Cited

U.S. PATENT DOCUMENTS 3,530,451 A 9/1970 Devine
5,479,149 A 12/1995 Pike
5,525,966 A 6/1996 Parish
5,598,151 A * 1/1997 Torii, Jr. ..... A47B 81/005 340/5.33
5,828,301 A 10/1998 Sanchez
6,415,541 B1 * 7/2002 Rassias ..... F41C 33/0227 42/70.11
7,168,198 B2 1/2007 Newkirk et al.
7,389,604 B2 6/2008 Newkirk et al.
7,714,720 B2 5/2010 Hietanen et al.
2007/0119088 A1 5/2007 Newkirk et al.
2007/0124979 A1 6/2007 Newkirk et al.
(Continued)

FOREIGN PATENT DOCUMENTS

WO 2006131590 A1 12/2006

*Primary Examiner* — Daniell L Negron

(74) *Attorney, Agent, or Firm* — Scott L. Harper; Griffith Bates Champion & Harper LLP

(57) ABSTRACT

A firearm monitoring and tracking system is a system for detecting the absence/removal of a firearm from a firearm holster. A firearm monitoring assembly is utilized to detect if the firearm is removed from the firearm holster. A proximity sensor is able to detect the removal of the firearm from the firearm holster. The firearm monitoring assembly and the proximity sensor are positioned in a manner such that the proximity sensor is able to detect the firearm's removal. Upon the firearm's removal, location data of the firearm is recorded with a geospatial positioning module along with audio data in the vicinity of the firearm through a microphone. Firearm discharge data is captured through an accelerometer. The location data, the audio data, and the firearm discharge data is then transmitted to at least one receiving device.

14 Claims, 8 Drawing Sheets

(56) References Cited

U.S. PATENT DOCUMENTS

| | | | | |
|---|---|---|---|---|
| 2010/0321186 | A1* | 12/2010 | Crook | G08B 25/10 340/568.6 |
| 2013/0308256 | A1* | 11/2013 | Lehr | G06F 1/266 361/679.01 |
| 2014/0162584 | A1 | 6/2014 | Cope | |
| 2014/0176363 | A1 | 6/2014 | Lam et al. | |
| 2014/0215885 | A1 | 8/2014 | Sullivan et al. | |
| 2015/0254968 | A1* | 9/2015 | Sanders | F41C 33/029 340/539.13 |

* cited by examiner

SECTION A-A

FIREARM MONITORING AND TRACKING SYSTEM

The current application claims a priority to the U.S. Provisional Patent application Ser. No. 62/187,916 filed on Jul. 2, 2015.

FIELD OF THE INVENTION

The present invention relates generally to a system for monitoring and tracking a firearm and user. More specifically, the present invention is a firearm monitoring and tracking system that monitors and tracks the location, removal from holster, and discharge of a firearm.

BACKGROUND OF THE INVENTION

The safety of officers is a significant concern for law enforcement agencies worldwide, particularly when officers are often required to perform their duties in potentially volatile and hostile environments. Officers generally have several equipment options for defending themselves in the line of duty. Non-lethal options include utilizing pepper spray to temporarily blind and disorient a perpetrator. Officers are often equipped with a Taser, allowing officers to temporarily subdue a perpetrator as well. Because of the available non-lethal options, a firearm is considered to be a last resort for a law enforcement officer's defense against a hostile perpetrator. A struggle over an officer's firearm can often be fatal due to the potential for an unintentional discharge of the firearm or the officer's loss of control over the firearm. In the event of a struggle, it is imperative that a dispatcher, another officer, or other law enforcement monitor is able to quickly assess the officer's situation and react accordingly to provide assistance to the officer. A dangerous situation can potentially become fatal if the officer is unable to call for support or provide information for the dispatcher to provide assistance.

Because a firearm is considered to be an officer's last resort for defense, any intentional or unintentional discharge of a firearm is a significant incident. One of the greatest hurdles to overcome when determining guilt or innocence of involved parties in a shooting incident is the lack of reliable witnesses and conflicting accounts provided by witnesses. Due to the aforementioned issues, it can often be difficult to accurately assess the details of a firearm discharge incident.

The present invention seeks to improve the safety of law enforcement officers in the line of duty as well as improve the ability to determine facts following a firearm discharge incident. The present invention is a firearm monitoring and tracking system that monitors and tracks the location, removal from holster, and discharge of a firearm. The present invention is able to provide information that a dispatcher or other law enforcement personnel are able to use to quickly assess an officer's situation and respond accordingly to provide support to the officer.

DETAIL DESCRIPTIONS OF THE INVENTION

Figure 1:
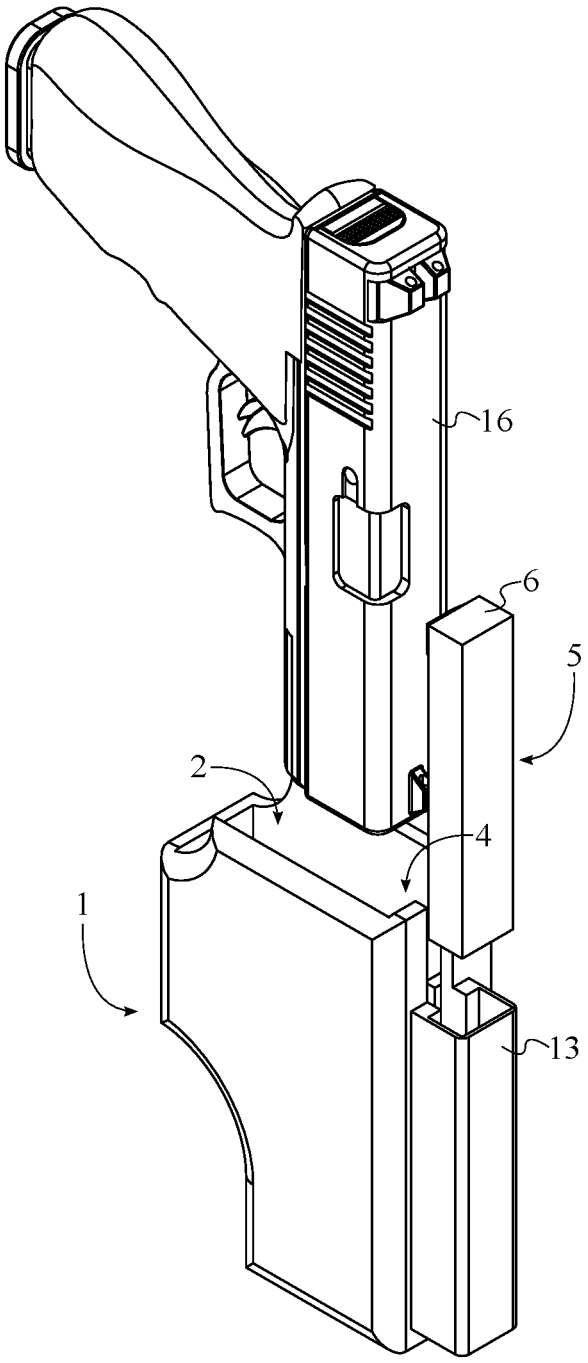
FIG. 1 is a front exploded perspective view of the present invention.
Figure 2:
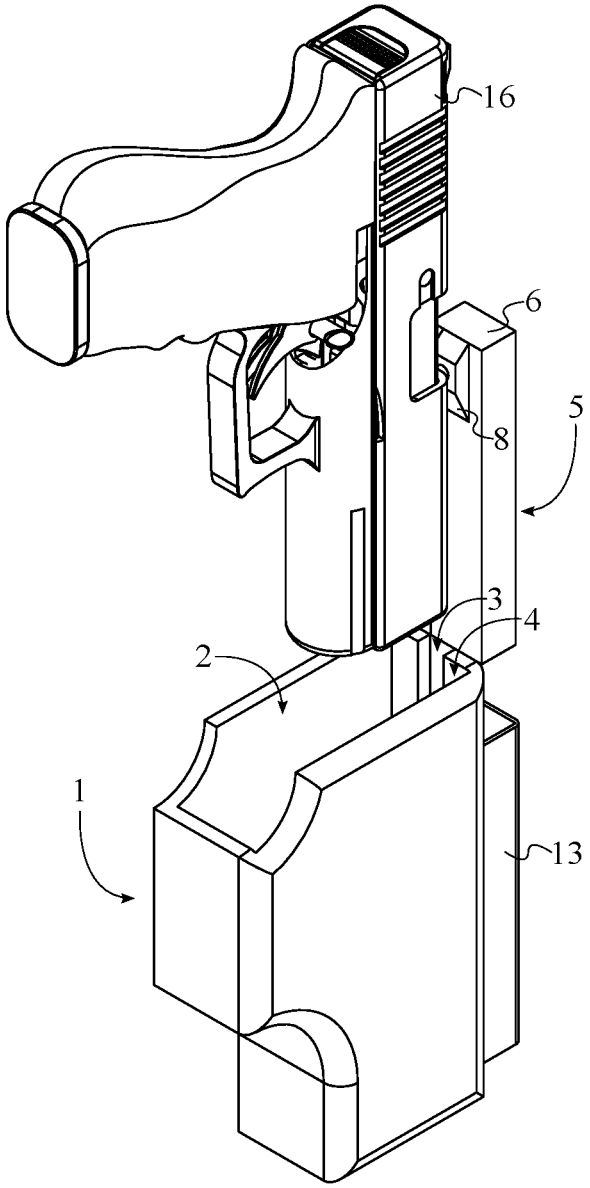
FIG. 2 is a rear exploded perspective view of the present invention.
Figure 3:
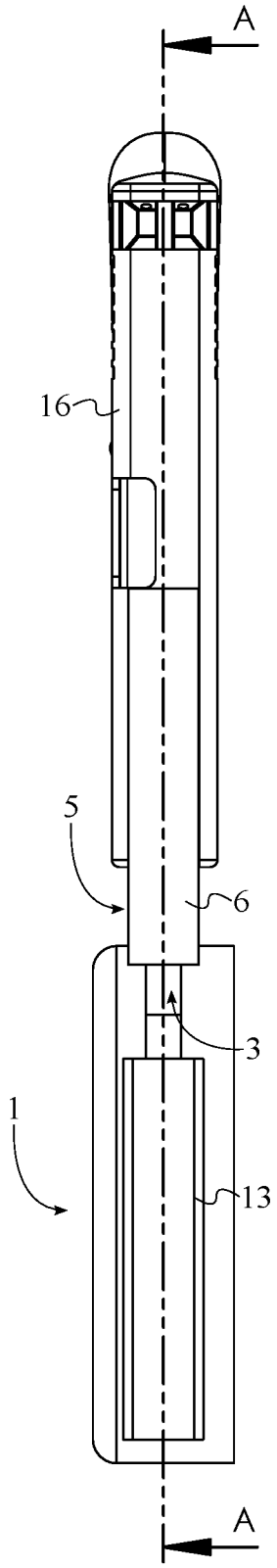
FIG. 3 is a front exploded view of the present invention.
Figure 4:
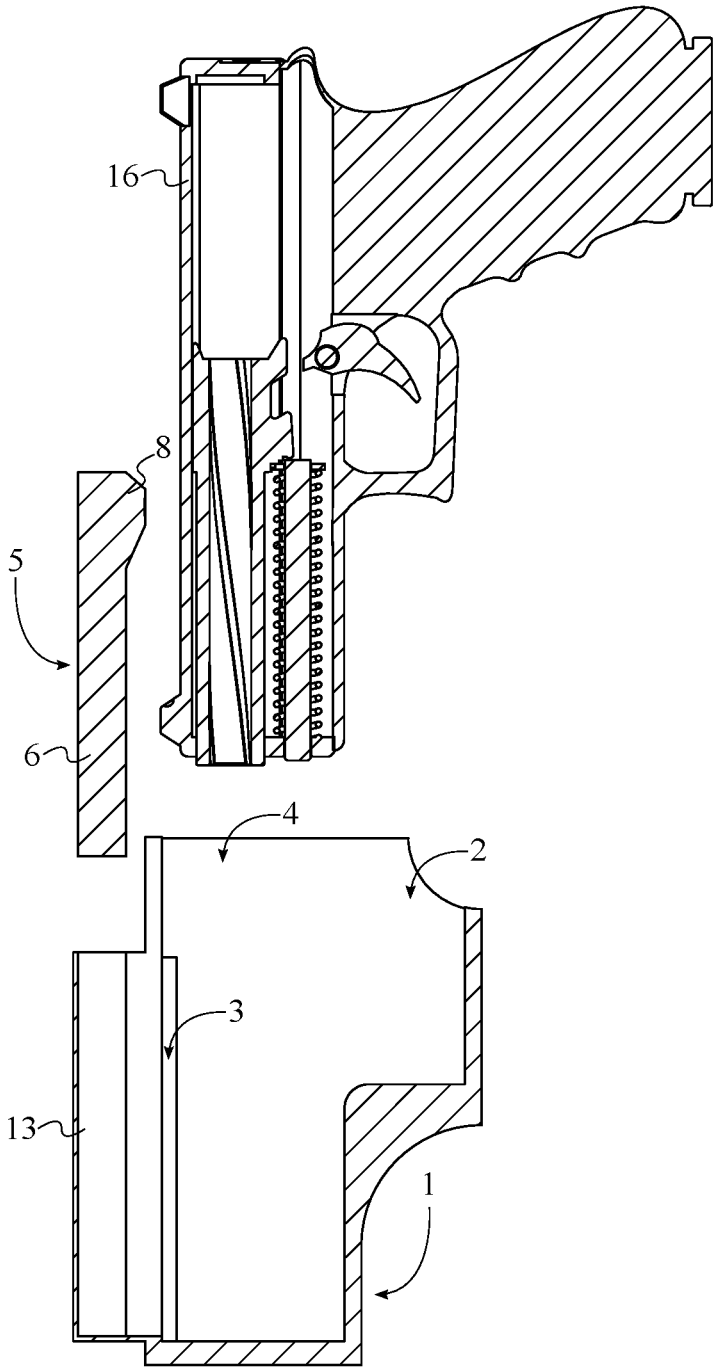
FIG. 4 is a cross-sectional view of the present invention taken along line A-A of FIG. 3.
Figure 5:
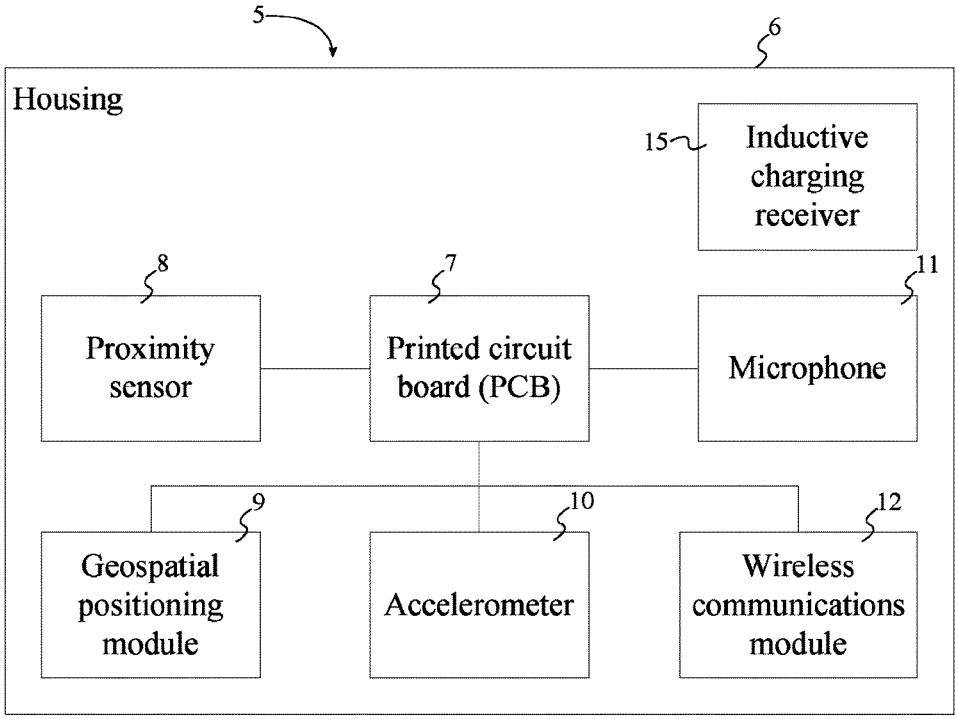
FIG. 5 is a diagram depicting electronic connections of the present invention.

All illustrations of the drawings are for the purpose of describing selected versions of the present invention and are not intended to limit the scope of the present invention.

The present invention is a firearm monitoring and tracking system for tracking the location, removal from holster, and discharge of a firearm. This, by extension, allows the present invention to monitor and track the user of the firearm, such as a law enforcement officer or similar asset. The present invention is shown in FIGS. 1-5 and comprises a firearm holster 1 and a firearm monitoring assembly 5. The present invention is intended for use with any firearm that is carried by a law enforcement officer or similar asset in the course of duty such as, but not limited to, a handgun.

The firearm holster 1 is capable of securely holding a firearm 16 on the user's body when not in use. The firearm holster 1 features a firearm pocket 2 into which the firearm 16 may be inserted and secured.

The firearm monitoring assembly 5 provides information regarding the firearm 16 and the firearm user to a monitoring party such as a dispatcher or other law enforcement personnel. With continued reference to FIGS. 1-5, the firearm monitoring assembly 5 comprises a housing 6, a printed circuit board (PCB) 7, a proximity sensor 8, a geospatial positioning module 9, an accelerometer 10, a microphone 11, and a wireless communications module 12. In the preferred embodiment of the present invention, the firearm monitoring assembly 5 is externally positioned to the firearm holster 1, adjacent to a firearm barrel-receiving pocket 4 of the firearm holster 1. This positioning enables the firearm monitoring assembly 5 to easily detect the presence or absence of the firearm 16 within the firearm holster 1 as well as to gather data regarding the location of the firearm 16, the discharge of the firearm 16, and the firearm user's current situation.

The housing 6 serves to protect the electronic components of the firearm monitoring assembly 5. The PCB 7 is the component to which the electronic components of the firearm monitoring assembly 5 are mounted. In the preferred embodiment of the present invention, the geospatial positioning module 9, the accelerometer 10, the microphone 11, and the wireless communications module 12 are enclosed within the housing 6. The housing 6 is thus able to provide protection for the electronic components of the firearm monitoring assembly 5 and prevent damage to the electronic components as well. In the preferred embodiment of the present invention, the proximity sensor 8 is externally mounted or wired to the housing 6. The proximity sensor 8 may thus be positioned in a manner such that the proximity sensor 8 is able to detect the presence, absence, or removal from the firearm holster 1 of the firearm 16. The proximity sensor 8 is removably attached to the housing 6, allowing the proximity sensor 8 to be separated from the housing 6 as needed. The proximity sensor 8, the geospatial positioning module 9, the accelerometer 10, the microphone 11, and the wireless communications module 12 are electronically connected to each other through the PCB 7. The electronic connection enables synergy amongst the proximity sensor 8, the geospatial positioning module 9, the accelerometer 10, the microphone 11, and the wireless communications module 12 when gathering data and providing information to the monitoring party.

The geospatial positioning module 9 is able to determine the location of the firearm monitoring assembly 5 and, by extension, the firearm 16 and the firearm user. The geospatial positioning module 9 thus enables another party to be notified of the location of the firearm monitoring assembly 5. The geospatial positioning module 9 may be, but is not limited to, a Global Positioning System (GPS) module. In addition to capturing the location coordinate information for the firearm monitoring assembly 5, the geospatial positioning module 9 is able to determine the altitude of the firearm monitoring assembly 5. An example application of this is utilizing the geospatial positioning module 9 to determine the specific floor level of a multistory building in which the firearm monitoring assembly 5 and the firearm user are located.

The accelerometer 10 is utilized to detect and measure the vibration, shock, acceleration, and motion that is characteristic of a firearm being discharged in the vicinity of the firearm monitoring assembly 5. The accelerometer 10 is thus able to determine if the firearm 16 has been discharged after the removal of the firearm 16 from the firearm holster 1 is detected by the proximity sensor 8.

The microphone 11 is able to capture audio in the vicinity of the firearm monitoring assembly 5. The microphone 11 is thus able to record the discharge of the firearm 16 as well, similar to the accelerometer 10. The live audio feed captured by the microphone 11 is provided to the monitoring party. The microphone 11 serves a number of useful applications including providing audio evidence of a confrontation between a law enforcement officer and a perpetrator.

The wireless communications module 12 enables wireless data transfer to the monitoring party and is utilized to wirelessly transmit location and altitude data, firearm discharge data, and audio data from the firearm monitoring assembly 5 to the monitoring party. The wireless communications module 12 additionally enables communication via call with the monitoring party. The wireless communications module 12 utilizes a data transfer module such as, but not limited to, a General Packet Radio Service (GPRS) modem. Alternative protocols may be utilized for transferring the data from the firearm monitoring assembly 5 to the monitoring party as well as for opening a communications channel between the firearm monitoring assembly 5 and the monitoring party.

The present invention further comprises a device sleeve 13. The device sleeve 13 is utilized to hold and protect the firearm monitoring assembly 5 when the firearm monitoring assembly 5 is in use with the firearm holster 1. The device sleeve 13 is externally connected to the firearm holster 1. The firearm monitoring assembly 5 may thus be positioned as close as possible to the firearm 16 within the firearm holster 1. The firearm monitoring assembly 5 is slidably engaged with the device sleeve 13, allowing the firearm monitoring assembly 5 to be easily removed from the device sleeve 13 as needed. The firearm monitoring assembly 5 may be externally mounted to the firearm holster 1, adjacent to the firearm pocket 2 of the firearm holster 1. This embodiment of the present invention enables use of the firearm monitoring assembly 5 with an existing firearm holster 1 without having to incorporate the device sleeve 13 onto the firearm holster 1.

The firearm holster 1 additionally comprises a clearance slot 3. The clearance slot 3 provides space for the proximity sensor 8 when the firearm monitoring assembly 5 is placed into the device sleeve 13. The clearance slot 3 traverses across the device sleeve 13 and the firearm pocket 2. The proximity sensor 8 is slidably engaged into the clearance slot 3. The clearance slot 3 is thus able to aid further in positioning the proximity sensor 8 as close as possible to the firearm 16 within the firearm holster 1. Additionally, the proximity sensor 8 is easily inserted into and removed from the clearance slot 3 and the device sleeve 13 along with the firearm monitoring assembly 5.

The proximity sensor 8 is a sensor that is utilized to detect the presence of the firearm 16 within the firearm holster 1. This additionally allows the proximity sensor 8 to detect when the firearm 16 is removed from the firearm holster 1 and/or when the firearm 16 is returned to the firearm holster 1. The present invention may utilize various types of sensors for the proximity sensor 8. For example, the proximity sensor 8 may be a ferrous proximity sensor. A ferrous proximity sensor is capable of detecting the nearby presence of ferrous metal such as steel. Because steel is a commonly utilized material when manufacturing firearms, the ferrous proximity sensor is able to detect the presence or absence of ferrous metal within the firearm holster 1. Another example proximity sensor 8 is a reflective optical sensor. A reflective optical sensor utilizes a receiver and a transmitter. The transmitter emits a light beam toward the firearm 16 within the firearm holster 1. The light beam is reflected off of the firearm and toward the receiver. The reflection of the light beam into the receiver is indicative of the presence of the firearm in the firearm holster 1. In the event that the firearm 16 is removed from the firearm holster 1, the reflective optical sensor is able to detect the absence of the firearm 16 due to the fact that the light beam is unable to reflect off of a surface and toward the receiver. The proximity sensor 8 may be a capacitive proximity sensor that is able to detect the position and/or change of position of the firearm 16 via capacitance, provided that the firearm 16 is composed of a conductive material. In a contemplated embodiment, the capacitive proximity sensor is utilized to detect any changes in capacitance between the capacitive proximity sensor and the firearm 16. The change in capacitance may be attributed to a change in the distance between the capacitive proximity sensor and the firearm 16. Finally, the proximity sensor 8 may be a lever or pressure switch. The lever or pressure switch may be engaged or disengaged by the action of removing the firearm 16 from the firearm holster 1. While these are examples of sensors that may be utilized for the proximity sensor 8, the present invention may utilize additional proximity sensors which are known in the art that are able to function in a similar manner to detect the presence or absence of the firearm 16 in the firearm holster 1.

Figure 6:
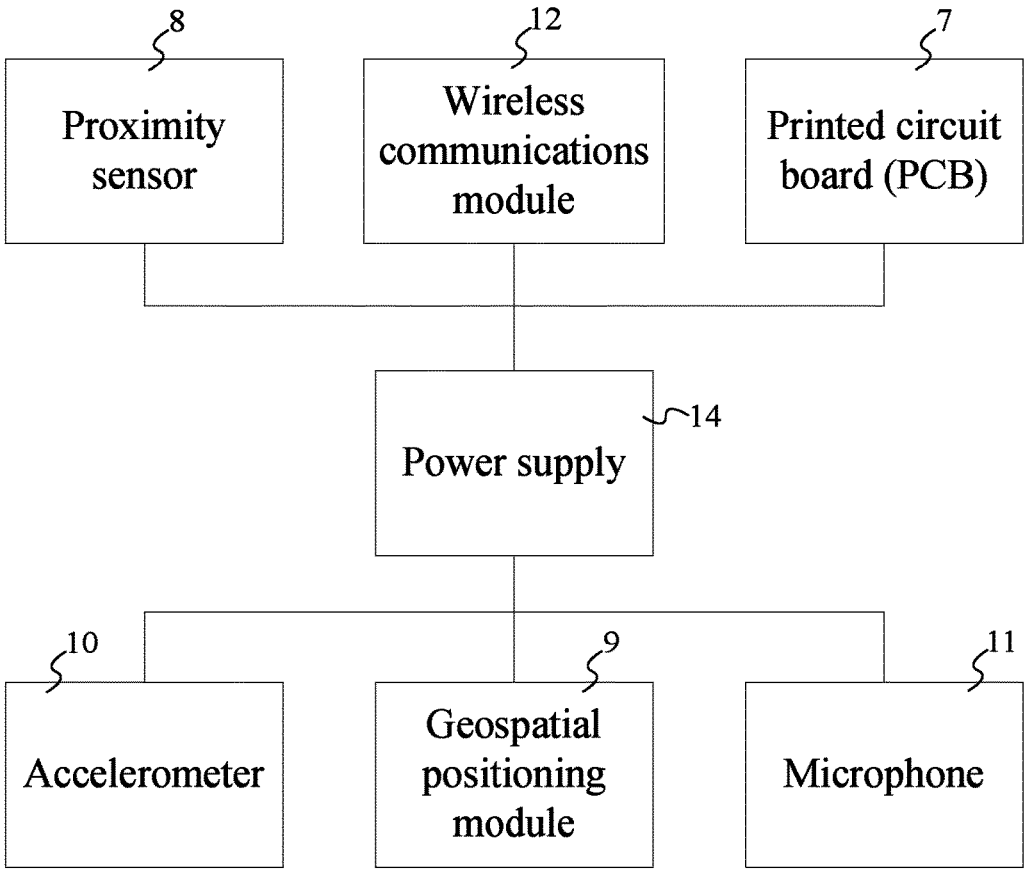
FIG. 6 is a diagram depicting additional electronic connections of the present invention.

The electronic components of the firearm monitoring assembly 5 receive electrical power via a power supply 14 as shown in FIG. 6. The power supply 14 may be, but is not limited to, a rechargeable battery. The power supply 14 is enclosed within the housing 6 for protection. The power supply 14 is electrically connected to the PCB 7, the proximity sensor 8, the geospatial positioning module 9, the accelerometer 10, the microphone 11, and the wireless communications module 12, enabling the power supply 14 to provide electrical power to the electronic components of the firearm monitoring assembly 5. The power supply 14 may or may not be removable from the housing 6. If the power supply 14 is not removable from the housing 6, a charging port may be utilized to charge the power supply 14 from an external electrical power source. The charging port may utilize Universal Serial Bus (USB) protocol or similar. The present invention may additionally comprise an inductive charging receiver 15 for wirelessly charging the power supply 14 in addition to or in lieu of charging via the charging port. The inductive charging receiver 15 is enclosed within the housing 6 as well for protection. The inductive charging receiver 15 is electrically connected to the power supply 14 and is generally an induction coil. As such, the inductive charging receiver 15 is able to charge the power supply 14 when the inductive charging receiver 15 draws power from an electromagnetic field generated by an external inductive charging transmitter (inductive coil). This is typically done by placing the firearm monitoring assembly 5 onto a charging pad with an inductive charging transmitter. The inductive charging receiver 15 converts the power to electric current in order to charge the power supply 14.

Figure 7:
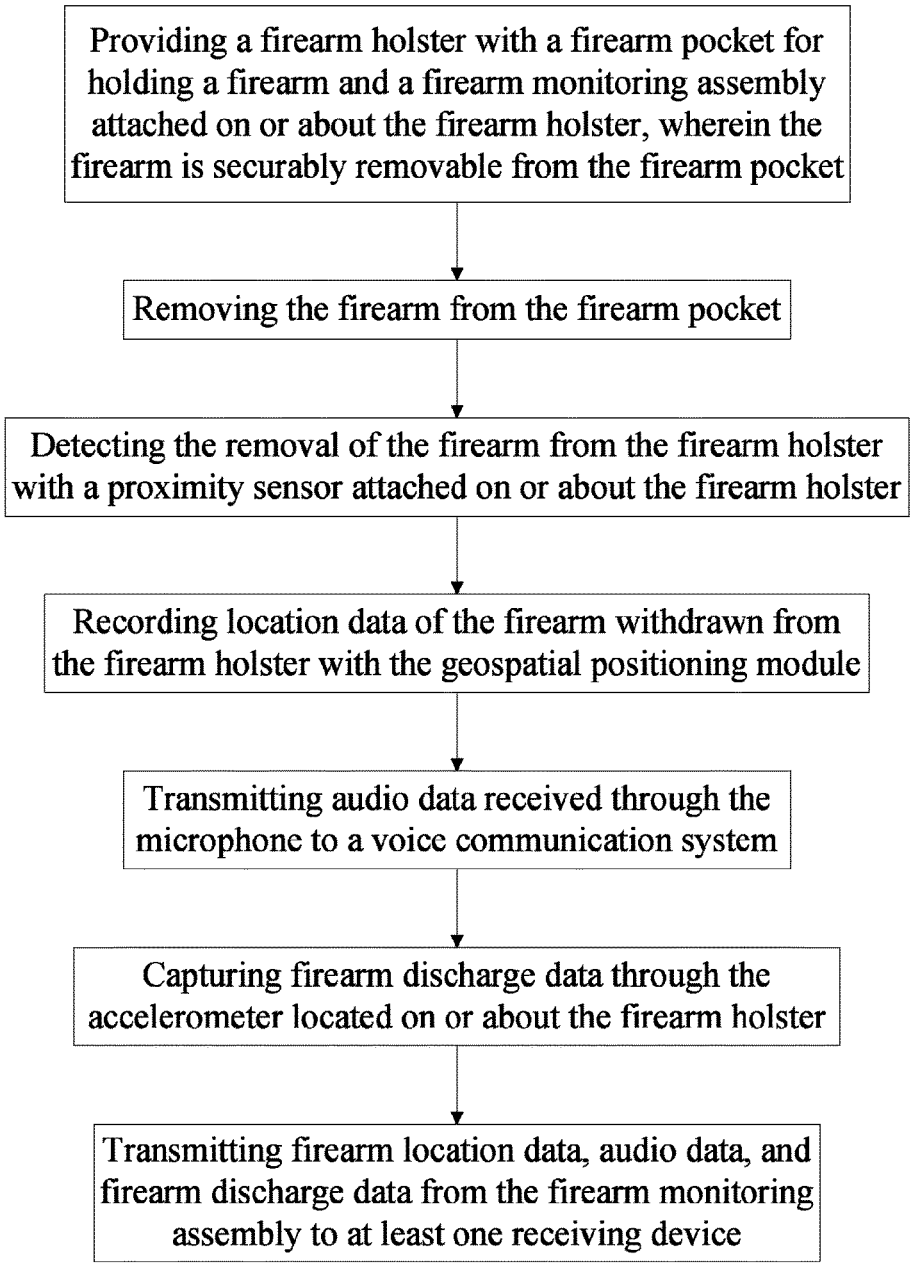
FIG. 7 is a flowchart depicting the method of the present invention.
Figure 8:
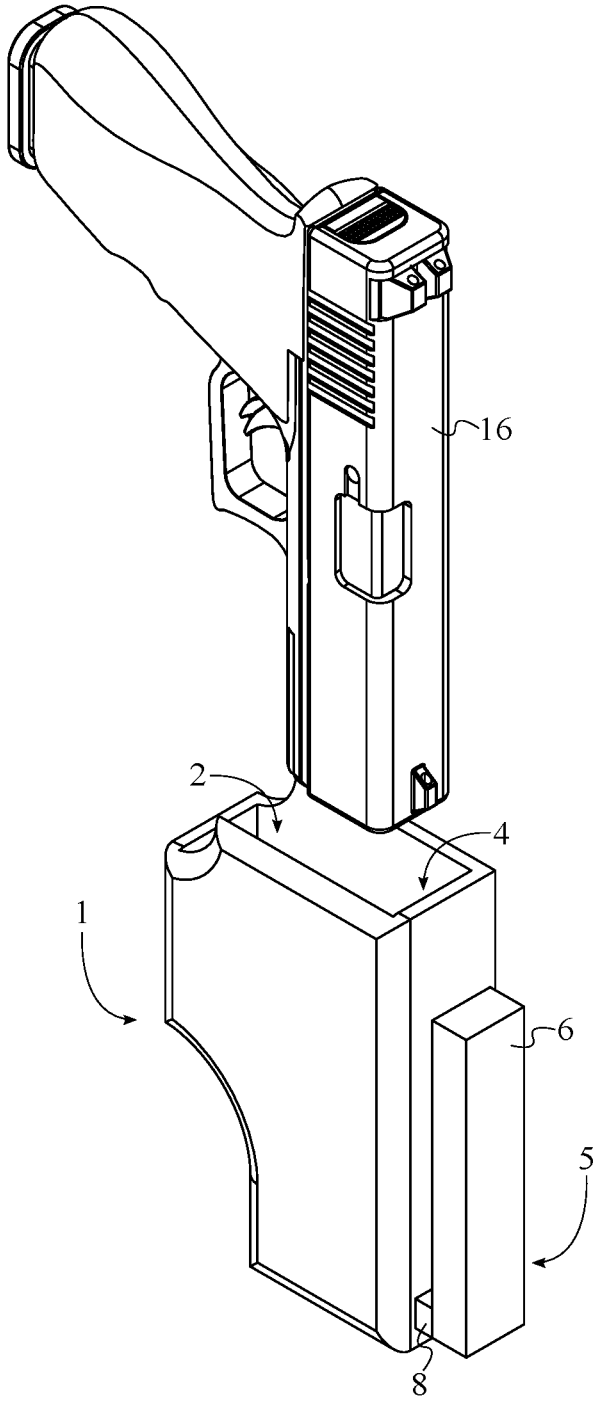
FIG. 8 is a front exploded perspective view of an alternative embodiment of the present invention in which the firearm monitoring assembly is mounted directly to the firearm holster.

During typical use, the present invention is able to interact with a monitoring party such as a dispatcher or other authorized personnel such as another officer. The monitoring party may be preprogrammed into the firearm monitoring assembly 5. The firearm monitoring assembly 5 is able to wirelessly communicate with at least one receiving device. The firearm monitoring assembly 5 is attached on or about the firearm holster 1 as shown in FIGS. 1-4. With reference to FIG. 7, the firearm 16 is securably removable from the firearm pocket 2. The firearm 16 is held within the firearm holster 1 when not in use and the presence of the firearm 16 within the firearm holster 1 is continuously monitored by the proximity sensor 8. The firearm monitoring assembly 5 detects whether the firearm 16 is within the firearm holster 1 through the proximity sensor 8. The firearm 16 is removed from the firearm pocket 2. The removal of the firearm 16 from the firearm holster 1 is detected with the proximity sensor 8 attached on or about the firearm holster 1. The removal may be detected via one of the previously discussed mechanisms. Upon removal of the firearm 16, location data of the firearm 16 is recorded with the geospatial positioning module 9. The location data notifies the monitoring party of the exact location of the firearm monitoring assembly 5 and, by extension, the firearm 16 and the firearm user. The location data additionally provides information about the altitude of the firearm monitoring assembly 5, for example, if the firearm user is in a multistory building. Audio data is received the microphone 11 and transmitted to a voice communication system as well if the firearm 16 is detected to be absent from the firearm holster 1. The microphone 11 continuously records audio in the vicinity of the firearm monitoring assembly 5, capturing any vocal interactions between the firearm user and others in the vicinity. The microphone 11 is additionally capable of capturing the report of the firearm 16, providing an indication that the firearm 16 has discharged. If the firearm 16 is detected to have discharged, firearm discharge data is captured through the accelerometer 10. The accelerometer 10 is able to detect the vibration, shock, acceleration, and motion that is indicative of a firearm discharge. The location data, the audio data, and the firearm discharge data from the firearm monitoring assembly 5 is transmitted to the at least one receiving device through a communication channel provided through the wireless communications module 12. This provides the monitoring party with a continuous status update of the firearm user. Data captured by the firearm monitoring assembly 5 may be wirelessly saved to a cloud storage server for recordkeeping and access after an event.

Although the present invention has been explained in relation to its preferred embodiment, it is understood that many other possible modifications and variations can be made without departing from the spirit and scope of the present invention as hereinafter claimed.

What is claimed is:

1. A firearm monitoring and tracking system comprises:

a firearm holster including a firearm pocket and a clearance slot;

a firearm monitoring assembly;

wherein the firearm monitoring assembly comprises a housing, a printed circuit board (PCB), a proximity sensor, a geospatial positioning module, an accelerometer, a microphone, and a wireless communications module;

the proximity sensor. the geospatial positioning module, the accelerometer, the microphone. and the wireless communications module being electronically connected to each other through the PCB;

the proximity sensor adapted to be engaged into the clearance slot; and the firearm monitoring assembly being removably and externally positioned to the firearm holster, adjacent to a firearm barrel-receiving pocket of the firearm holster.

2. The apparatus of claim 1, wherein the proximity sensor is externally mounted or wired to the housing.

3. The apparatus of claim 1, wherein the geospatial positioning module, the accelerometer, the microphone, and the wireless communications module are enclosed within the housing.

4. The apparatus of claim 1, wherein the proximity sensor is removably attached to the housing.

5. The apparatus of 1 claim further comprising:

a device sleeve;

the device sleeve being externally connected to the firearm holster; and the firearm monitoring assembly being slidably engaged with the device sleeve.

6. The apparatus of claim 5, wherein the clearance slot traverses across the device sleeve and the firearm pocket.

7. The apparatus of claim 1, wherein the proximity sensor is slidably engaged into the clearance slot.

8. The apparatus of claim 1, wherein the firearm monitoring assembly is externally mounted to the firearm holster adjacent to the firearm pocket of the firearm holster.

9. The apparatus of claim 1, wherein the proximity sensor is a ferrous proximity sensor.

10. The apparatus of claim 1, wherein the proximity sensor is a reflective optical sensor.

11. The apparatus of claim 1, wherein the proximity sensor is a capacitive proximity sensor.

12. The apparatus of claim 1 , wherein the proximity sensor is a lever or pressure switch.

13. The apparatus of claim 1 further comprising:

a power supply; and the power supply being electrically connected to the PCB, the proximity sensor, the geospatial positioning module, the accelerometer, the microphone, and the wireless communications module.

14. The apparatus of claim 1 further comprising:

an inductive charging receiver, wherein the inductive charging receiver is enclosed within the housing.

* * * * *